US006364457B1

(12) United States Patent
Colecchi et al.

(10) Patent No.: US 6,364,457 B1
(45) Date of Patent: Apr. 2, 2002

(54) CONTINUOUS INK JET PRINTING HEAD HAVING FEEDBACK CONTROL HOUSING PARTS AND FIELD REPLACEABLE FILTER AND NOZZLE ASSEMBLIES

(75) Inventors: Paul S. Colecchi, Schaumburg; Robert I. Keur, Niles, both of IL (US)

(73) Assignee: Sphere Connections, Inc., Schaumburg, IL (US)

( * ) Notice: Subject to any disclaimer, the term of this patent is extended or adjusted under 35 U.S.C. 154(b) by 0 days.

(21) Appl. No.: 09/770,742

(22) Filed: Jan. 24, 2001

(51) Int. Cl.[7] ..... B41J 2/14
(52) U.S. Cl. ..... 347/47; 239/468
(58) Field of Search ..... 347/47, 44, 20, 347/49, 73, 74, 75; 239/468, 601

(56) References Cited

U.S. PATENT DOCUMENTS 3,708,118 A * 1/1973 Keur ..... 239/1
3,972,474 A * 8/1976 Keur ..... 239/102.2
4,396,640 A * 8/1983 Rocheleau et al. ..... 427/8
6,193,172 B1 * 2/2001 Soule et al. ..... 239/468

* cited by examiner

*Primary Examiner*—N. Le
*Assistant Examiner*—Shih-Wen Hsieh
(74) *Attorney, Agent, or Firm*—Charles F. Lind

(57) ABSTRACT

The disclosed continuous ink jet printer nozzle assembly defines a flow path having a powered sonic oscillator associated therewith for inputing vibrations to ink flowing in the path, and a cavity for holding closely adjacent but isolated from the ink flow path one or more sensors operable to detect ink vibrations and/or temperatures immediately downstream from the oscillator, whereby such sensed information can be used in feedback controls for changing input power to the oscillator and/or heater/cooler unit upstream of the oscillator, for stabilizing the printed ink pattern. The nozzle assembly further is formed of three subassemblies: an ink driver subassembly having the powered oscillator and sensor(s), and filter and orifice subassemblies respectively adapted to be connected in serial self-aligned sealed orientations to the exterior upstream and downstream sides of the ink driver subassembly, thereby allowing field replacement of the filter and/or orifice subassemblies.

9 Claims, 3 Drawing Sheets

CONTINUOUS INK JET PRINTING HEAD HAVING FEEDBACK CONTROL HOUSING PARTS AND FIELD REPLACEABLE FILTER AND NOZZLE ASSEMBLIES

BACKGROUND OF THE INVENTION

Continuous ink jet printing involves the formation, from a continuous cylindrical ink stream being discharged from an appropriately sized orifice in a nozzle assembly, of tiny equally spaced and sized ink droplets, which are then individually redirected to strike a target area at specific locations suited to form an intended message. To achieve this droplet flow stream, the liquid ink in the nozzle assembly is subjected to ultrasonically pulsated pressures created by utilizing both a steady moderate pressure system and a piezoelectric crystal oscillator associated with and coupled to the nozzle assembly. Utilizing suitable synchronizing controls, each ink droplet will then be left uncharged or will be selectively charged electrically to a specific but varied potential upon passing a charging electrode or ring proximate the ink droplet stream. Thereafter, each charged droplet will be passed proximate electrically charged deflection plates, to be redirected laterally to impact then against the media (which typically will be paper, plastic, metal, etc. moving laterally past the nozzle) and effectively print thereon one or more lines of meaningful letters, numbers, symbols or like characters. The uncharged droplets will strike a collecting gutter for delivery back to the ink reservoir and reuse.

FIG. 1 illustrates schematically the above-noted ink flow loop 12 and components including ink reservoir 14, pump 16, pressure regulator 18, nozzle assembly 20, droplet charging electrode 22, droplet deflecting plates 24, ink return collector 26; and the ink discharge stream 27 and the diverted ink droplet stream 28 therefrom that is to impact against the media 30. Piezoelectric oscillator 32 is also shown associated with nozzle assembly 20, as is thermoelectric heater/cooler 36 in the ink flow loop 12. Moreover, conventional controls including respective feedback vibration and temperature sensors 33, 37; vibration and temperature power input setting devices 34, 38; and vibration and temperature comparators 35, 39 can be provided for sensing the ink vibrations and temperatures associated with the discharged ink droplets and for adjusting power to the oscillator and/or heater/cooler in an attempt for stabilizing the resulting desired printing pattern. However, such feedback sensors for the comparative compensating systems typically have been located remotely from the nozzle assembly (not as shown, inasmuch as that shown represents the inventive sensor locations), resulting overall in inaccurate and/or unreliable corrections.

This invention relates to an improved nozzle assembly 20, specifically suited for overcoming drawbacks, problems or difficulties experienced in existing continuous ink jet printing systems.

Specifically, all conventional nozzle assemblies utilize a very small orifice (in the range between 36–80 microns) so that orifice clogging with reduced print quality thereafter is a common threat. A filter commonly is mounted in the nozzle assembly upstream of the orifice to help prevent particles from making their way to the orifice. Clogging particles can be present due to sloppy manufacturing, such as being left between the filter and the orifice, or can be generated as precipitates of ink salts due to charging currents used while printing. Further, a properly functioning filter over time will become blocked, and quite quickly in dusty atmospheres containing high concentrations of particulate. As the filter is located internally of the nozzle assembly, filter replacement thus requires the nozzle assembly to be disassembled, which when attempted in the field in most cases is very difficult.

One current continuous ink jet printing system attempts to clean the nozzle orifice without dismantling it, and provides a port open to the nozzle interior between the filter and orifice, the port being closed during normal printing operation. However, when it is desirous to clean a clogged orifice, a suction is applied to the port which serves to withdraw ink through this port and from the nozzle interior as well as makeup air and/or solvent drawn backward through the orifice. However, blockage removal is not guaranteed, particularly blockage caused by fibers which are most difficult to remove.

One existing nozzle assembly supports the orifice in a removable plate, so that upon clogging, the entire orifice plate can be removed, to allow for orifice cleaning and/or replacement. The problem with this approach is that the orifice plate is held gaped from an adjacent face of the nozzle body, with an O-ring surrounding the ink flow path snugged therebetween to preclude leakage, and adjusted by three triangularly arranged screws to align the discharging ink flow stream accurately on target. This alignment task requires schooling and/or practice, so that in the field orifice replacement is difficult and/or can only be done by qualified technicians.

Moreover, different printing operations or systems might need different sizes of nozzle orifice, but as in the field nozzle orifice replacement is so difficult, time consuming, or technically demanding, a user might commonly stock in inventory different printing heads (at great expense per print head), each having a specific needed nozzle orifice size for the specific printing operation or system.

Further, although the sonic vibration level produced by the piezoelectric oscillator can be set, based on system hardware and ink stream printing requirements, to breakdown the cylindrical ink stream discharge into the properly sized and separated droplet stream, even minor changes from this vibration level or in the ink temperature might cause varied or unstable printing patterns. More specifically, physical ink properties (surface tension being the most prevalent) and sonic coupling of the powered driving oscillator signal via the nozzle body to the ink contained therein typically change with changes in the ink temperature. As noted, efforts to stabilize the ink flow include feedback sensors and controls effective for modifying the input power to the oscillator and/or the ink heater/cooler; but such can be inconsistent or inaccurate due to the remote locations of the sensor(s) from the powering oscillator.

SUMMARY AND OBJECTS OF THE INVENTION

This invention relates to continuous ink jet printing systems, and more particularly, to an improved nozzle assembly used therein.

An object of this invention is to provide a continuous ink jet printing system nozzle assembly that an operator can service on site, such as for removing the nozzle orifice for cleaning and/or for changing to a different needed size, and/or for removing the particle filter when necessary and replacing it with a new one, all quite quickly and easily and without any need for realigning the discharging ink flow stream.

Another object of this invention is to provide a continuous ink jet printer system nozzle assembly having structure selectively holding one or more sensors in close proximity to the flowing ink stream, for detecting ink vibrations and/or temperatures and/or other property, whereby accurate and instantaneous feedback might be available that with suitable conventional controls can modify the sensed ink property and thereby stabilize the set discharging ink flow stream or printing pattern.

A specific feature of this invention is a continuous ink jet printer nozzle assembly defining a through passage for the ink flow, the nozzle assembly and through passage being comprised of separate main ink driver and orifice subassemblies separably held relative to one another by the driver subassembly having an axially extended exteriorly open cavity or bore for receiving and providing, with an O-ring therebetween, a sealed mechanically snug self-aligning fit for said orifice subassembly, for allowing easy and accurate in the field operator servicing removal and replacement of the orifice subassembly without a need for subsequent realignment of discharging ink flow stream or printer pattern.

Another specific feature of this invention is a continuous ink jet printer nozzle assembly having structures including a conduit defining an ink flow path and a sonic oscillator associated therewith, and one or more transverse bores terminating in close proximity to but isolated from the ink flow path and downstream from the oscillator suited to detect instantaneous properties of the ink stream flowing through the conduit, including the ink temperature and/or imparted sonic vibrations, etc., whereby such sensed feedback with suitable controls can vary power inputs to driver mechanisms including an ink heater/cooler and/or the sonic oscillator for maintaining a stable discharging ink flow stream or printer pattern.

BRIEF DESCRIPTION OF THE DRAWINGS

The above noted objects, advantages and features will be more completely understood and appreciated upon reviewing the following specification, the accompanying drawings being a part thereof, wherein.

DESCRIPTION AND EXPLANATION OF THIS INVENTION

Figure 1:
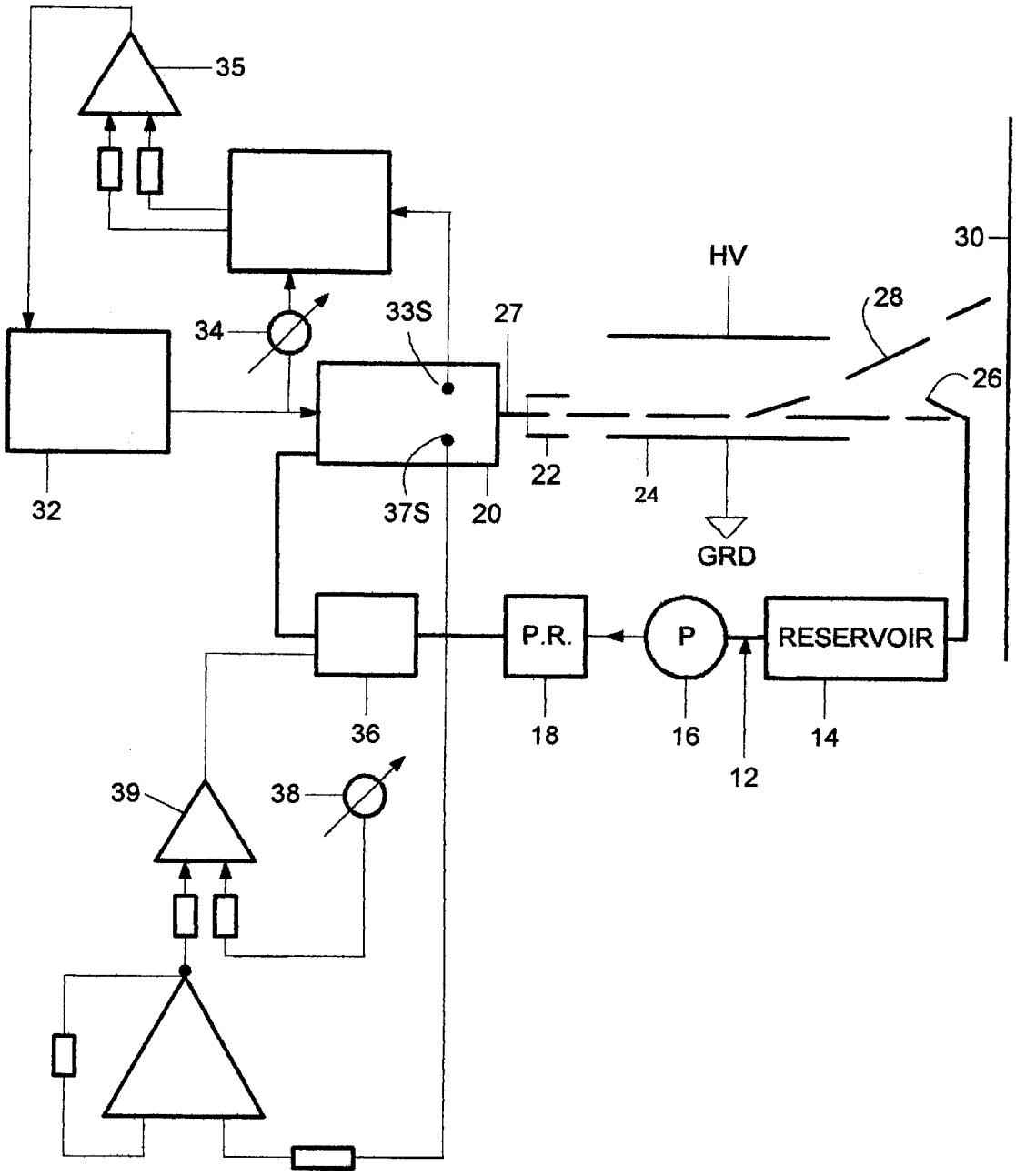
FIG. 1 is a schematic view of the subject invention, shown incorporated in a continuous ink jet printer ink flow loop and various two feedback circuits for detecting ink temperatures and imposed vibrations.
Figure 2:
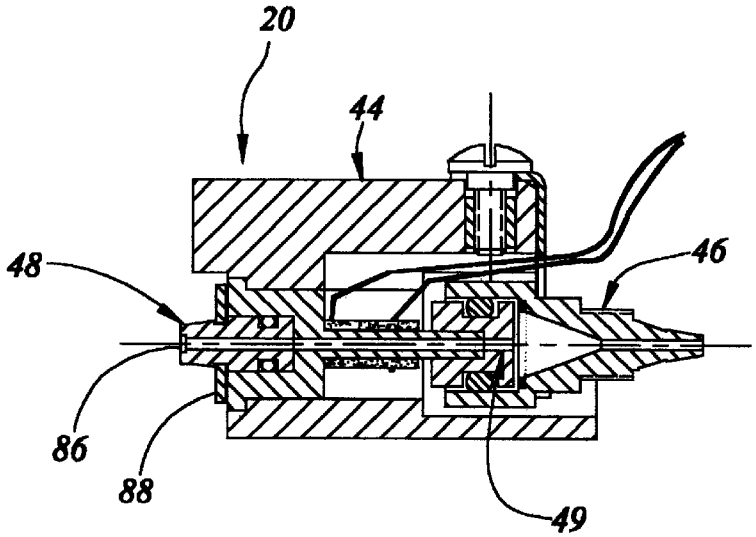
FIG. 2 is a cross sectional view of the improved nozzle assembly disclosed herein.
Figure 3:
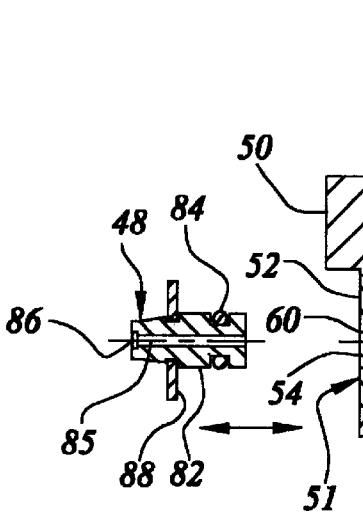
FIGS. 3, 4 and 5 illustrate respectively three subassemblies used to form the nozzle assembly of FIG. 2.
Figure 4:
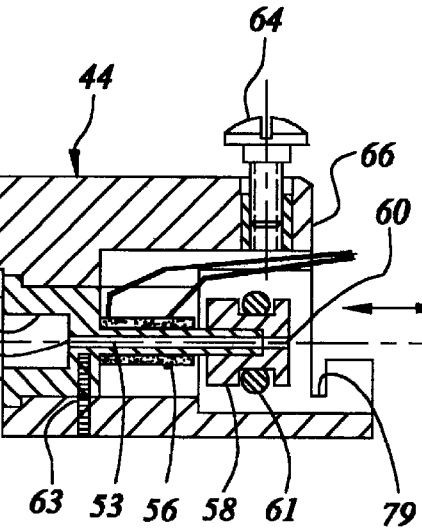
Figure 5:
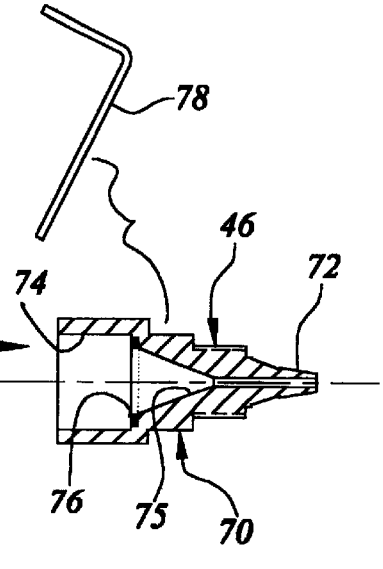
Figure 6:
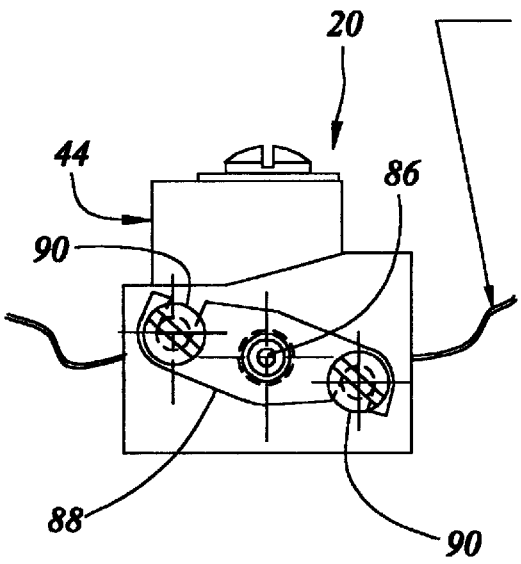
FIGS. 6 and 7 are end views, as seen respectively from the left and right ends of FIG. 2.
Figure 7:
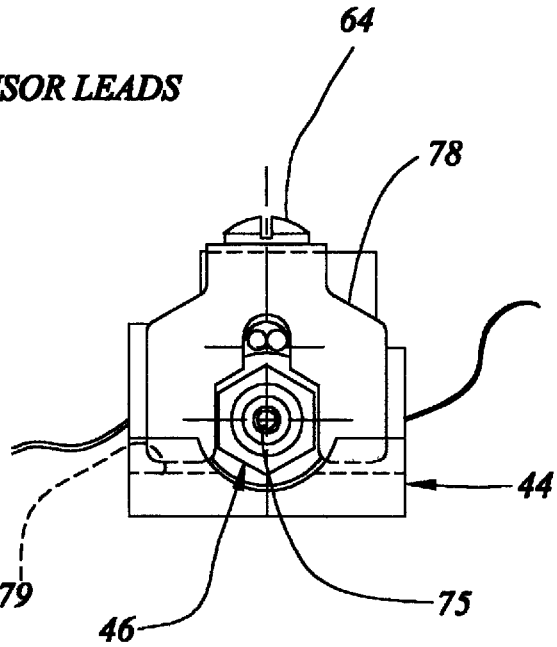
Figure 8:
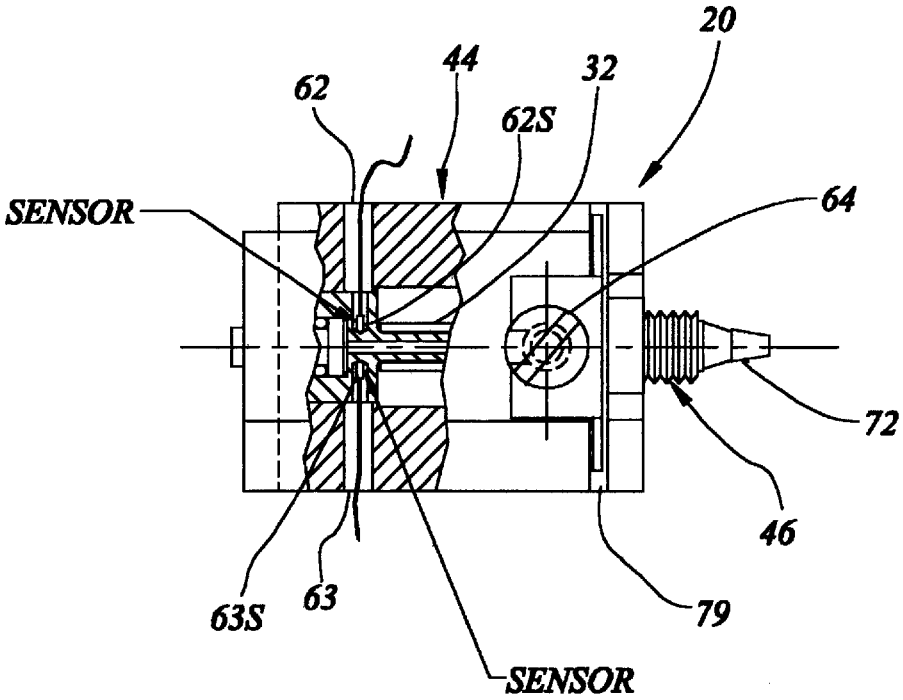
FIG. 8 is a top view of FIG. 2, partly broken in section to illustrate the defined ink flow path and proximate sensors.

The inventive nozzle assembly 20 (illustrated in FIG. 2) is formed by three subassemblies: driver subassembly 44, filter subassembly 46, and orifice subassembly 48, illustrated respectively in FIGS. 4, 3 and 5. In the description herein, the terms "upstream" or "downstream" relate to the direction of nominal ink flow through the subassemblies or assembly. The driver subassembly 44, filter subassembly 46 and orifice subassembly 48 when operatively coupled together define ink flow passageway or path 49 from the upstream filter subassembly 46 for discharge from the downstream orifice subassembly 48.

The driver subassembly 44 includes housings 50, 51 secured together, with housing 51 having enlarged downstream segment 52 and smaller upstream tube or conduit 53, with a passageway 54 extended axially through the housing. The piezoelectric crystal oscillator 32 is operatively bonded onto the tube 53 adjacent the enlarged segment 52, and an annular seal block 58 is sealed onto the upstream tube end. The block 58 has passageway 59 therein that communicates with the upstream end of passageway 54, and an exterior groove for holding sealing O-ring 61. The housing 51 further has in segment 52 a cylindrical cavity 60 concentrically surrounding but larger than the downstream end of the passageway 54, suited for releasibly retaining the orifice subassembly 48 as will be noted. Opposed transverse ports 62, 63 are illustrated between the piezoelectric crystal oscillator 32 and the cylindrical cavity 60, ending short of and thus isolated from the passageway 54. Sensors 62*s*, 63*s* (for detecting ink temperatures and vibrations, etc.) can be embedded in the respective ports 62, 63 closely adjacent but yet isolated from the passageway 54. A headed bolt 64 is threaded relative to a tap in housing 50, in close proximity to the upstream housing face 66, to be moved transversely to tube 53 and sealing block 58 for releasibly retaining the filter subassembly 46 as will be noted.

The filter subassembly 46 includes annular housing 70 having a small upstream end 72 suited to be seated within a flexible hose (not shown) that can be clamped thereon and having a larger downstream end with cylindrical wall 74 sized to fit in a snug sealed relationship over the driver assembly seal block 58 and O-ring 61 held thereon. The housing 70 has a through passageway 75, with an interior corner between the upstream and downstream subassembly ends suited to receive and retain a conventional flat filter 76 in place across the passageway 75. A slotted L-shaped clamp plate 78 can be fitted snugly onto the filter housing 70, to lie against the housing 50 and fit into cross groove 79, and to be held thereat by headed bolt 64 passing through a plate opening. These structures effectively hold the driver and filter subassemblies 44, 46 together, and while all are located on the exterior of the ink driver subassembly, allow rapid and easy disassembly and reassembly of the filter subassembly.

The orifice subassembly 48 has a cylindrical plug like body 82 sized to complement and fit snugly within the exteriorly open downstream housing cavity 60, with a sealing O-ring 84 held in a groove thereon for establishing a leakproof connection. The plug body 82 has a through passageway 85, and a jewel orifice 86 of suitable selected opening size is fixedly contained in the orifice body at the downstream end thereof communicating with the passageway. The orifice 86 is axially centered within the plug body and sized for directing, with the adjacent flow path ink under appropriate pressures, a substantially cylindrical ink stream discharge along a centered and precise axial downstream direction relative to and away from the orifice subassembly. A cross bar 88 axially keyed but rotatable within an exterior body groove, has opposite ends suited to be held firmly against the exterior downstream face of the housing, such as by screws 90 threaded into taps in the housing. These structures, with the complementary and exteriorly accessible fit of the cylindrical orifice body 82 within housing cavity 60, provide for easy and rapid in the field removal and replacement of the orifice subassembly 48 relative to the driver subassembly 44, with automatic and accurate self alignment of ink discharge from the outlet orifice 86 of a similar replacement orifice subassembly.

Replacement of the orifice and filter subassemblies is thus simplified and easy with the disclosed three piece nozzle assembly; while the sealed complementary cylindrical cooperation between the subassemblies automatically orients the components in proper alignment for stabilizing the discharging ink flow streams 27, 28 or printing patterns, and without the needed skills or drudgery for manually realigning the ink stream.

The sensor cavities 62, 63 and sensors 62*s*, 63*s* are close to but isolated from passageway 54 and the ink therein, allowing the detection of ink properties during actual ink jet printing, without electrical shorting problems between the conductive ink and sensor conductors. As sensors 62s, 63s are located between oscillator 32 and jewel outlet orifice 86, they sense confined stimulated ink at a location where even small differences of either ink temperature or vibrations can significantly change the actual ink discharge stream 27. A small piezoelectric element can be used for the vibration sensor, and/or a thermocouple or thermistor can be used for the temperature sensor.

It will be appreciated that a printing system typically will be set up to operate at selected ink pressures, vibrations and temperatures, the latter two being set by fine tuning power inputs to oscillator 32 and thermoelectric heater/cooler 36, to provide ink stimulation that yields acceptable ink droplet formation and printing quality. However, changing ink temperatures will alter the ink surface tension and viscosity, and the resulting discharging ink stream. Further, changes in coupling efficiency of oscillator 32 on ink driver tube 53 could alter the confined ink vibrations and resulting ink droplet formation. However, automatic maintenance of stable print quality can be achieved with the illustrated sensors and conventional feedback controls by responding to ink property changes and adjusting input power to the oscillator 32 and/or cooler/heater 36.

For example, the formation of separated ink droplets generally provide that tiny satellites will also be formed from filaments connecting these droplets before separation; but for good printing quality, these satellites must be eliminated before actual printing impact; and initial setup adjustments of the properly designed printing system will forwardly merge the satellites with the droplets they were attached to during droplet charging. However, the illustrated reactive sensors and feedback controls can now further provide for automatic maintenance of proper ink stream stimulation and stable acceptable print quality by adjusting the input power to the oscillator 32 and/or cooler/heater 36, responsive to accurately sensed ink properties that cause changes from the initial setup ink discharge stream and ink drop formation.

The driver subassembly housing 51 (tube 53) supporting the piezoelectric ultrasonic oscillator 32 might be made of a durable but acoustically soft plastic, such as trademark products DELRIN and/or NORYL, for effectively providing and containing the pulsed liquid ink and reliable vibration transmission while attenuating mechanical resonances. The orifice subassembly body 82 might be stainless steel or firm plastic, for durably and accurately holding the orifice 86 as aligned during manufacture, for providing proper alignment of the ink discharge stream. The filter subassembly can be made of structural plastic.

By way of example, the ink flow path 54 between oscillator 56 and jewel outlet orifice 86 might be between 0.02–0.05" in diameter, and could be no more than 1" long; and the sensors 62*s*, 63*s* might be spaced radially from this flow path region by no more than approximately 0.02–0.05", providing only minor thermal delay detecting the actual ink temperature in this critical flow region. Moreover, because the vibration sensor operates independently of the powered sonic oscillator 32, it will detect the actual instantaneous vibrations of the confined ink just prior to being discharged from the jewel outlet orifice.

While only a single embodiment is illustrated, changes thereto or modifications therefrom can be made by a person skilled in the art. Consequently, the scope of the invention is to be limited only by the following claims.

What is claimed is:

1. A nozzle assembly for mounting in a continuous ink jet printer system designed for printing legible patterns, comprising the combination of the nozzle assembly having separate ink driver and orifice subassemblies adapted when in assembled association to define an internal ink flow path;

said orifice subassembly having a downstream side with a jewel outlet opening communicating with said ink flow path and operable for directing an ink discharge along a specific and precise downstream substantially cylindrical stream relative to and away from said orifice subassembly;

said ink driver subassembly having a sonic oscillator mounted thereon proximate the ink flow path operable for imparting sonic vibrations to ink contained in the flow path and having exposed downstream side surfaces contoured to define a cavity open axially and in the direction downstream of the sonic oscillator and the ink flow path and said orifice subassembly having exterior surfaces suited to cooperate snugly and telescopically with said cavity surfaces, operable upon relative axial movement without any rotation of the subassemblies toward one another to provide an aligned assembled association of said subassemblies, whereby said ink discharge stream will be in proper alignment without manual realignment efforts of the orifice subassembly and/or the ink driver subassembly;

seal means between the cooperating surfaces of the aligned subassemblies for precluding ink leakage therepast; and means accessible from the exterior of said nozzle and driver subassemblies and operable directly between the subassemblies for releasibly holding the subassemblies in said assembled association, operable to accommodate field replacement of the nozzle subassembly without disturbing the driver subassembly even while yet mounted in the printer system.

2. A continuous ink jet printer nozzle assembly according to claim 1, further comprising said ink driver subassembly downstream side cavity surfaces being in the form of an axially extended exteriorly open cylindrical bore and the orifice subassembly exterior surfaces being shaped and sized to complement and mechanically fit snugly within said driver subassembly bore in said assembled association.

3. A continuous ink jet printer nozzle assembly according to claim 2, further providing said seal means being comprised as an O-ring interposed between the cooperating surfaces of the ink driver and orifice subassemblies in said assembled association.

4. A continuous ink jet printer nozzle assembly according to claim 2, further comprising said ink driver subassembly having exposed accessible side surfaces surrounding the ink flow path upstream of the sonic oscillator; a separate filter subassembly; means joining the filter subassembly to the upstream side of the ink driver subassembly, opposite the assembled orifice subassembly and defining a continuation of said ink flow path axially through the nozzle assembly;

said joining means including said respective surfaces on the ink driver and filter subassemblies disposed to cooperate and provide, upon relative axial telescoping movement of the filter and ink driver subassemblies toward one another, a self-aligned assembled association of these subassemblies; seal means between the cooperating surfaces of these aligned ink driver and filter subassemblies; and means accessible from the exterior of said ink driver subassembly and operable directly between the ink driver and filter subassemblies for releasibly holding the ink driver and filter subassemblies in said assembled association, allowing for in the field replacement of the filter subassembly without disturbing the ink driver subassembly even while yet mounted in the printer system.

5. A continuous ink jet printer nozzle assembly according to claim 4, further providing each of said seal means being comprised as an O-ring interposed between the cooperating surfaces of the respective assembled ink driver and filter subassemblies for containing ink in said flow path.

6. A continuous ink jet printer nozzle assembly according to claim 1, further comprising the combination of the ink driver subassembly having a sonic oscillator mounted thereon proximate the ink flow path operable for imparting sonic vibrations to ink contained in the flow path, and the ink driver subassembly further having downstream from the sonic oscillator a cavity for holding closely adjacent but isolated from the ink flow path one or more sensors operable to detect characteristics of the ink in the flow path, such as the ink vibrations, whereby feedback controls can use this sensed information for fine tuning the input power to the sonic oscillator so as stabilize the printed ink patterns.

7. A continuous ink jet printer nozzle assembly according to claim 6, further comprising a separate filter subassembly; means joining the filter subassembly to the upstream side of the ink driver subassembly, opposite the assembled orifice subassembly and defining a continuation of said ink flow path axially through the nozzle assembly; said joining means including respective exposed surfaces on the ink driver and filter subassemblies disposed to cooperate and provide, upon relative axial telescoping movement of the filter and ink driver subassemblies, a self-aligned assembled association of these filter and ink driver subassemblies; seal means between the cooperating surfaces of these aligned filter and ink driver subassemblies; and means releasibly holding the ink driver and filter subassemblies in said assembled association, allowing for in the field replacement of the filter subassembly without disturbing the ink driver subassembly even while yet mounted in the printer system.

8. A continuous ink jet printer nozzle assembly according to claim 7, further providing each of said seal means being comprised as an O-ring interposed between the cooperating surfaces of the respective assembled ink driver and orifice subassemblies and the respective ink driver and filter subassemblies for containing ink in said flow path.

9. A nozzle assembly for mounting in a continuous ink jet printer system designed for printing legible patterns, comprising the combination of the nozzle assembly having tubular structure defining an ink flow path and an ink driving sonic oscillator mounted on the tubular structure in close association with the flow path operable for imparting sonic vibrations to ink in the flow path and a jewel outlet opening communicating with said ink flow path downstream of the sonic oscillator operable for directing a continuous generally cylindrical ink stream discharge along a specific and precise downstream direction relative to and away from said nozzle assembly; and the nozzle assembly tubular structure further having downstream from the oscillator and upstream of the jewel orifice outlet a closed end cavity for holding closely adjacent but isolated from the ink flow path one or more sensors operable to detect one or more physical properties, such as vibrations and/or temperatures of ink flowing in the flow path, whereby such sensed information(s) can be used in feedback control(s) for changing input power to the oscillator and/or ink heater/cooler unit upstream of the nozzle assembly in the ink flow stream, effective for maintaining the printed ink pattern stable.

* * * * *